US010392820B2

(12) United States Patent
Heady et al.

(10) Patent No.: US 10,392,820 B2
(45) Date of Patent: Aug. 27, 2019

(54) POWER BRACE SPANNER

(71) Applicant: POWER BRACE LLC, Des Moines, IA (US)

(72) Inventors: Timothy P. Heady, Elkhart, IA (US); Charles W. Heady, Perry, IA (US)

(73) Assignee: Power Brace, LLC, Des Moines, IA (US)

( * ) Notice: Subject to any disclaimer, the term of this patent is extended or adjusted under 35 U.S.C. 154(b) by 7 days.

(21) Appl. No.: 15/476,577

(22) Filed: Mar. 31, 2017

(65) Prior Publication Data

US 2018/0283023 A1 Oct. 4, 2018

(51) Int. Cl.

| | |
|---|---|
| ***E04G 23/02*** | (2006.01) |
| ***E02D 37/00*** | (2006.01) |
| ***E02D 31/12*** | (2006.01) |
| ***E02D 31/14*** | (2006.01) |

(52) U.S. Cl.

CPC ..... *E04G 23/0229* (2013.01); *E02D 31/12* (2013.01); *E02D 31/14* (2013.01); *E02D 37/00* (2013.01); *E04G 23/0222* (2013.01)

(58) Field of Classification Search

CPC . E04G 23/0229; E04G 23/0222; E02D 31/14; E02D 37/00; E02D 31/12; H02G 3/125

USPC ..... 52/698, 702, 707, 712, 713, 289, 291, 52/293, 293.1, 293.2, 293.3, 294–299, 52/643, 317, 111, 127.2, 710, 711; 248/200.1, 298.1, 295.11

See application file for complete search history.

(56) References Cited

U.S. PATENT DOCUMENTS 1,105,284 A * 7/1914 McMurtrie ..... H02G 3/125 220/3.9
2,316,389 A * 4/1943 Atkinson ..... H02G 3/126 174/63
2,676,680 A * 4/1954 Kindorf ..... E04B 9/183 238/342
3,054,447 A * 9/1962 Brydolf ..... E05D 7/0027 16/245
3,077,009 A * 2/1963 Hutchinson ..... E04C 3/02 52/632
3,541,321 A * 11/1970 Spiteri ..... B60Q 1/305 362/390
4,158,896 A * 6/1979 Farkas ..... A47K 3/38 135/90

(Continued)

*Primary Examiner* — Theodore V Adamos
(74) *Attorney, Agent, or Firm* — McKee, Voorhees & Sease, PLC

(57) ABSTRACT

An improved system for straightening and/or supporting a wall is provided. The system includes a joist spanner system that may be attached to an elongated vertical member positioned to abut a wall. The joist spanner system may include an inner bracket and an outer bracket in slidable or telescopic communication with one another. The inner bracket and outer bracket may each include a slot or track to provide slidable or telescopic adjustment of the spanner system. The slot or track may also provide an adjustable point for attaching the spanner system to the elongated vertical member. The inner bracket and outer bracket may also each include an end plate configured to be positioned to abut opposing joist members. The end plates may also include one or more apertures configured to receive a fastener for securing the spanner system to opposing joist members.

14 Claims, 9 Drawing Sheets

(56) References Cited

U.S. PATENT DOCUMENTS 4,669,704 A * 6/1987 Abraham ..... E02D 37/00 254/100
4,763,878 A * 8/1988 Abraham ..... E02D 37/00 254/100
4,893,784 A * 1/1990 Abraham ..... E02D 37/00 254/100
5,343,667 A * 9/1994 Peden ..... E04G 17/06 249/219.1
5,459,967 A * 10/1995 Bodtker ..... E04B 7/00 182/82
5,845,450 A * 12/1998 Larsen ..... E02D 35/00 248/351
5,934,631 A * 8/1999 Becker ..... H02G 3/125 248/200.1
5,938,157 A * 8/1999 Reiker ..... E04B 9/006 156/71
6,357,190 B1 * 3/2002 Florentine ..... E02D 37/00 248/351
6,434,893 B1 * 8/2002 Quenzi ..... E04G 11/48 52/1
6,519,791 B2 * 2/2003 Randolph ..... E03C 1/021 4/695
6,591,574 B2 * 7/2003 Humphrey ..... E04G 13/00 248/200.1
6,767,278 B1 * 7/2004 Peterson ..... F24F 1/027 248/200.1
6,768,071 B1 * 7/2004 Gretz ..... H02G 3/20 174/50
7,275,731 B1 * 10/2007 Shinault ..... E04G 17/06 248/354.5
7,419,335 B1 * 9/2008 Cohen ..... E04G 23/0218 248/351
7,429,021 B2 * 9/2008 Sather ..... E03C 1/33 248/200.1
7,918,054 B2 * 4/2011 Grafton ..... E04L 37/02 248/291.1
8,136,317 B1 * 3/2012 McCown ..... E02D 35/00 52/167.1
8,403,277 B2 * 3/2013 Nuernberger ..... H02G 3/125 174/58
8,459,600 B2 * 6/2013 Tarr ..... A63H 19/36 211/124
8,925,267 B1 * 1/2015 Kirby ..... E04G 23/0218 248/354.3
9,022,326 B2 * 5/2015 Brown ..... F16L 3/08 138/103
9,404,257 B2 * 8/2016 Reno ..... E04C 3/02
9,422,734 B1 * 8/2016 Heady ..... E04G 23/04
9,556,608 B2 * 1/2017 Smith ..... E04B 1/40
2002/0062612 A1 * 5/2002 Heady ..... E02D 37/00 52/514
2003/0131555 A1 * 7/2003 Heady ..... E02D 37/00 52/741.15
2006/0010703 A1 * 1/2006 Gauthier ..... E04G 21/1891 33/613
2006/0207215 A1 * 9/2006 Bruno ..... E04G 17/14 52/745.12
2006/0260219 A1 * 11/2006 Riddle ..... E04G 21/1891 52/127.2
2006/0260261 A1 * 11/2006 Cervenko ..... E04F 13/0807 52/712
2007/0012847 A1 * 1/2007 Tai ..... E04B 9/006 248/343
2007/0200039 A1 * 8/2007 Petak ..... H02G 3/125 248/219.1
2011/0252729 A1 * 10/2011 Birch ..... E04B 2/827 52/243.1
2011/0280682 A1 * 11/2011 Egawa ..... F02M 35/10085 411/337
2012/0247059 A1 * 10/2012 Daudet ..... E04B 1/2403 52/705
2014/0332637 A1 * 11/2014 Buttars ..... F16L 3/08 248/56
2014/0353442 A1 * 12/2014 Ye ..... H02G 3/125 248/200.1
2015/0060616 A1 * 3/2015 Jaramillo ..... A47B 81/061 248/200.1
2016/0126711 A1 * 5/2016 Colangelo ..... F16B 2/22 220/3.3
2017/0229852 A1 * 8/2017 Jones ..... E04C 3/32

* cited by examiner

POWER BRACE SPANNER

FIELD OF THE INVENTION

The present disclosure relates generally to reinforcing and/or bracing of a foundation. More particularly, but not exclusively, the present disclosure relates to a system and method for straightening and/or supporting a wall, particularly a wall that has been damaged due to expansive soils, hydrostatic pressure, freezing ground water, and/or other reasons. Even more particularly, but not exclusively, the present disclosure relates to a system and method for straightening and/or supporting a wall that includes a spanner configured to allow a vertical support member to be positioned at a location between two joists.

BACKGROUND OF THE INVENTION

Many of today's homes include basements, which are at least partially subterranean. The basement foundation walls are designed to support vertical loads more so than lateral loads from the surrounding earth. As a result, upon exposure to excessive lateral forces, foundation walls often crack, bow, push inward, or even collapse. The forces are associated with expansive soils, hydrostatic pressure, water pooling from downspouts, and/or freezing ground water, foundation settlement, and the like.

The foundation reinforcement systems commonly known in the art are deficient for a variety reasons. For example, wall anchoring systems counteract soil pressure by anchoring walls to stable, undisturbed soil outside the wall, which often requires significant excavation of surrounding earth. Further, given the varying types of soils outside of the wall, such systems are prone to failure. Therefore, a need exists in the art for a reinforcement system that does not require excavation of and/or rely on the use of soil exterior to the wall.

Many indoor foundation reinforcement systems occupy a large amount of interior space. For example, braces extending diagonally from the floor to the foundation wall significantly limit interior space of a room proximate to the foundation wall, often limiting overall function and enjoyment of the room. Furthermore, prior wall reinforcement systems may tie into ceiling and/or floor joists to provide the necessary support. However, tying a support system directly into the ceiling and/or floor joists may limit the spacing of the support members to match the existing joist spacing. Therefore, a need exists in the art for a reinforcement system that minimizes the intrusive effect and maximizes the interior space proximate to the wall and is aesthetically pleasing. Additionally, a further need exists in the art for a spanner assembly that allows for a support member to be positioned at a location between two opposing joists.

BRIEF SUMMARY OF THE INVENTION

Therefore, it is a primary object, feature, and/or advantage of the invention to improve on and/or overcome the deficiencies in the art.

It is another object, feature, and/or advantage of the invention to provide a joist spanner assembly with slidably connected inner and outer brackets configured to be positioned between two adjacent joist members. Wherein the brackets may include top, bottom, side, and rear surfaces.

It is yet another object, feature, and/or advantage of the invention to provide a joist spanner assembly wherein the rear surface of the inner and outer brackets each comprise an elongated aperture or slot configured to slidably align.

It is a further object, feature, and/or advantage of the invention to provide a joist spanner assembly wherein the side surfaces of the inner bracket and outer bracket are configured to abut adjacent members.

It is still a further object, feature, and/or advantage of the invention to provide a wall support system including a joist spanner assembly and a generally vertical support member with first and second ends. Wherein the joist spanner is positioned between two adjacent joist members and the first end of the vertical support member may be slidably attached to the spanner assembly by a fastener passing through an inner slot and an outer slot of the inner bracket and outer bracket respectively. The second end of the vertical support member may be secured proximate to the floor.

It is still yet a further object, feature, and/or advantage of the invention to provide a wall reinforcement system that maximizes the interior space proximate to the wall and is aesthetically pleasing.

It is still yet a further object, feature, and/or advantage of the invention to provide a system and/or method of straightening and/or supporting portions of the wall between vertical support members. The horizontal structural members extending between the vertical structural members can prevent any excessive localized stress at a midpoint between adjacent vertical support members.

It is still yet a further object, feature, and/or advantage of the invention to provide a system of straightening and/or supporting a wall with a vertical support member positioned at any location between adjacent joist members. The vertical support member may be positioned to abut the wall, extending in a generally vertical direction between a floor and ceiling. The vertical support member may have a first end and a second end, wherein the first end is slidably attached to a spanner assembly positioned between adjacent joist members and the second end is attached proximate the floor.

It is still yet a further object, feature, and/or advantage of the invention to provide a method of straightening and/or supporting a wall by positioning a spanner assembly between adjacent joists and slidably adjusting an inner and outer bracket of the spanner assembly to abut the adjacent joist members. A vertical support member positioned to abut the wall may include a first end and a second end, wherein the first end may be slidably attached to the spanner assembly at a location between the adjacent joist members.

It is still yet a further object, feature, and/or advantage of the invention to provide a channel bracket configured to be slidably attached to a support member, wherein the support member may be part of an wall reinforcement system. The channel bracket may include a body and opposing side members extending perpendicularly from one or more edges of the body. The side members may include tabs or lips extending from the side members opposite the body of the channel bracket. Furthermore, the channel bracket may also include one or more apertures in the body. The aperture may be for attaching a device or apparatus to the channel bracket. The aperture may also be configured to secure the channel bracket to the support member.

According to an aspect of the invention, a system for straightening and/or supporting a wall is provided. The system may include a spanner assembly having an inner and outer bracket in slidable communication with one another. The inner and outer bracket may each have a side surface or plate with one or more apertures and configured to removably mount the brackets to adjacent joist members. The inner and outer bracket may each also include a slotted aperture, track, or elongated hole. The elongated hole of each bracket may be configured to align with one another when the inner and outer brackets are slidably engaged.

The elongated hole of the outer bracket may be wider than the elongated hole of the inner bracket. The wider elongated hole of the outer bracket may be configured to receive a protruded portion of a bolt or nut, wherein said protrusion is configured to slidably engage an interior surface of the elongated hole. Furthermore, the bolt, nut, or similar fastener may be utilized to slidably attach the spanner assembly to a vertical support member. The vertical support member may include a first end and a second end and be configured to abut the wall to be supported by the system. The first end may be slidably attached to the spanner assembly which is positioned between two adjacent joist members. The second end of the vertical support member may be attached or fixed at a location proximate the floor. The system for straightening and/or supporting a wall may include a plurality of spanner assemblies and vertical support members spaced and/or positioned along one or more walls. The vertical support members may be oriented in a generally parallel configuration relative to one another. The vertical support members may also be interconnected by one or more horizontal members.

According to another aspect of the invention, a method for straightening and/or supporting a wall includes providing a spanner assembly configured to be mounted in between adjacent joist members. The spanner assembly may include an inner and outer bracket in slidable communication with one another. The inner and outer bracket may each have a side surface or plate with one or more apertures and configured to removably mount the brackets to adjacent joist members. The inner and outer bracket may each also include a slotted aperture, track, or elongated hole. The elongated hole of each bracket may be configured to align with one another when the inner and outer brackets are slidably engaged. The method may also include providing an elongated vertical support member configured to abut the wall. The elongated vertical support member may include a first end that is slidably attached to the spanner assembly via a fastener passing through the elongated holes of the spanner assembly. The elongated member may also have a second end, opposite the first end, wherein the second end is configured to be affixed at a location proximate the floor.

The method may further include positioning the spanner assembly between adjacent joist members and slidably adjusting the spanner assembly to abut the side surfaces of the inner and outer bracket against the adjacent joist members. The elongated member may be positioned to abut the wall, and the first end may be secured to the spanner assembly. Furthermore, the second end may be secured at a location proximate the floor.

The method may further include the step of providing a horizontal support member. The horizontal support member may be secured to the vertical support member and an adjacent vertical support member.

These and/or other objects, features, and advantages of the invention will be apparent to those skilled in the art. The invention is not to be limited to or by these objects, features and advantages. No single embodiment need provide each and every object, feature, or advantage.

Figure 1:
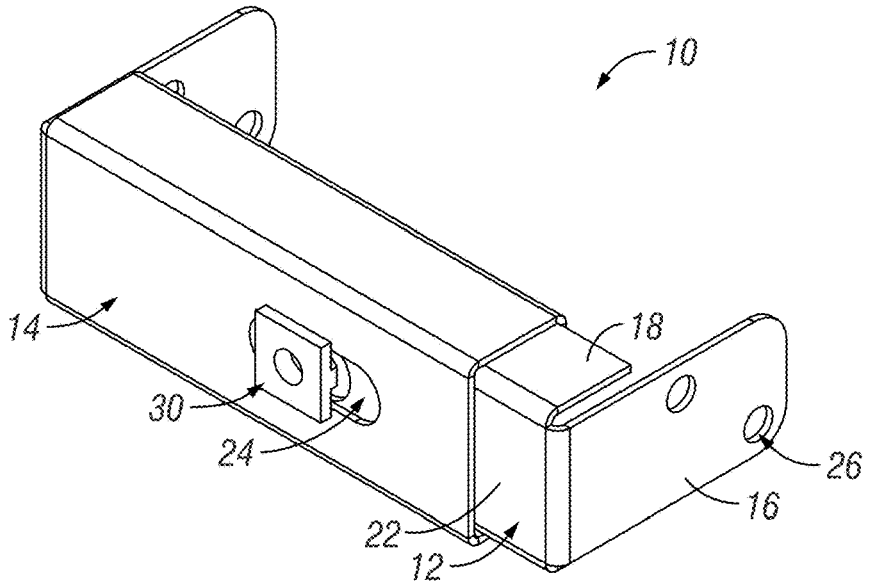
FIG. 1 is a perspective view of an exemplary embodiment of a spanner assembly.

Various embodiments of the invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION

The invention is directed towards a system, method, and apparatus that includes a spanner assembly 10. The spanner assembly 10 may be utilized as a component of a wall reinforcement system 38. An example of a wall reinforcement system 38 is shown and described in U.S. Ser. No. 14/932,225, now U.S. Pat. No. 9,422,734, which is herein incorporated by reference in its entirety.

Figure 2:
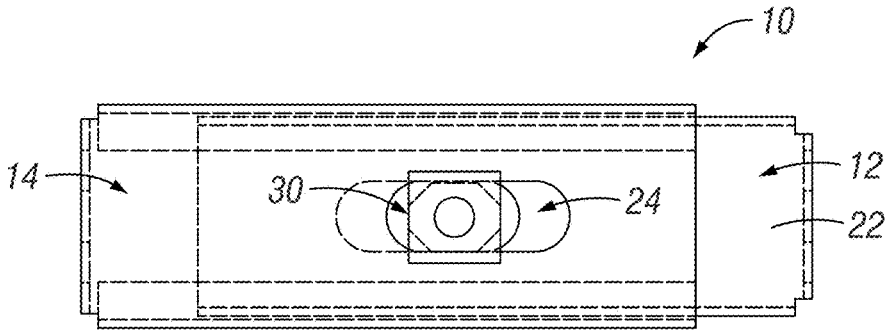
FIG. 2 is a rear view of the perspective view of the spanner assembly of FIG. 1.
Figure 3:
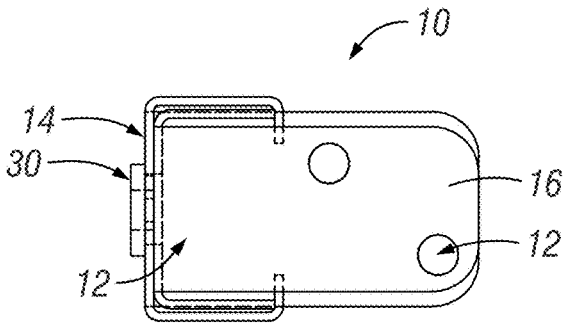
FIG. 3 is a side view of the perspective view of the spanner assembly of FIG. 1.
Figure 7:
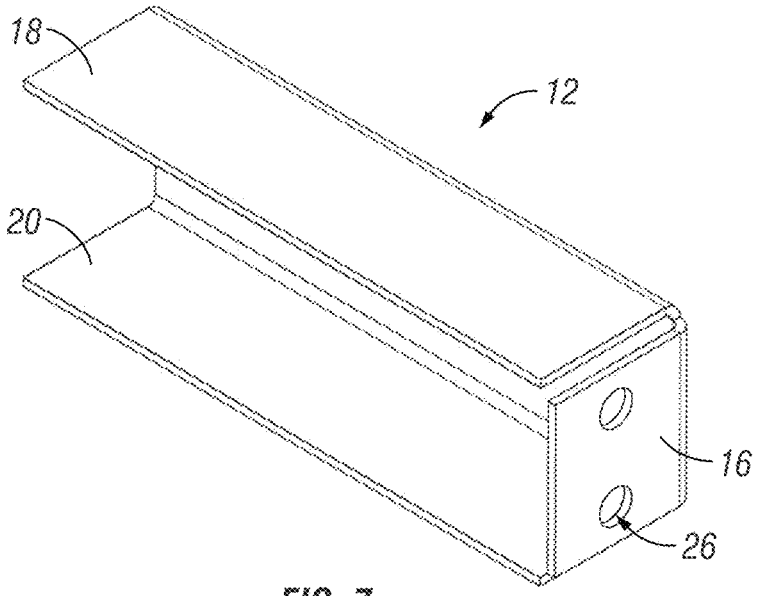
FIG. 7 is a perspective view of a bracket of the spanner assembly of FIG. 1.
Figure 8:
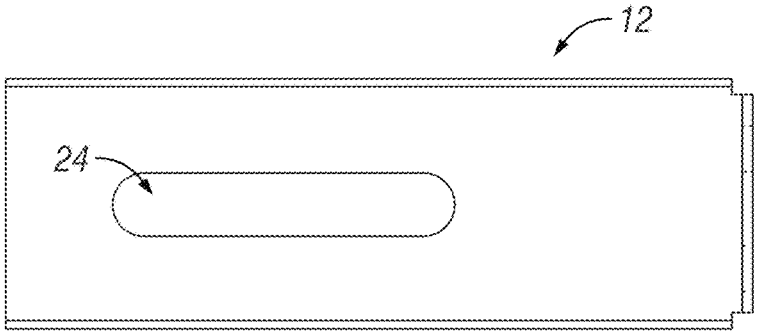
FIG. 8 is a front view of the bracket of FIG. 7.
Figure 9:
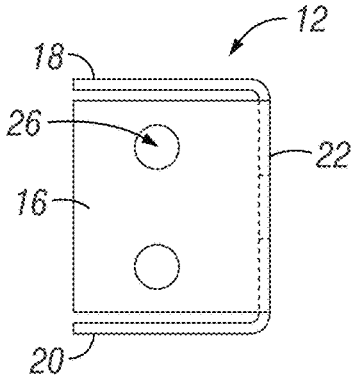
FIG. 9 is a side view of the bracket of FIG. 7.
Figure 10:
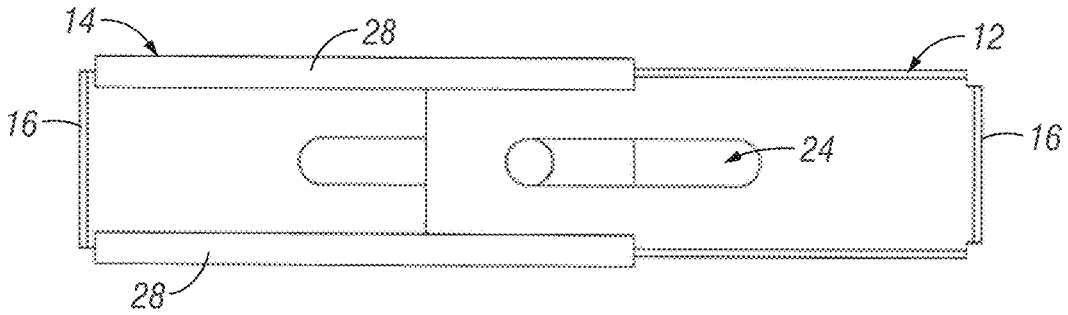
FIG. 10 is a front view of an alternative embodiment of a spanner assembly.
Figure 11:
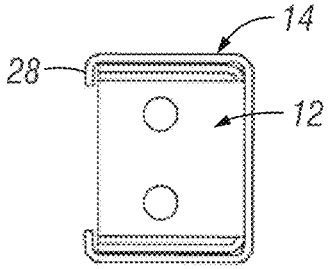
FIG. 11 is a side view of the spanner assembly of FIG. 10.

Referring to FIGS. 1-3, various views of an example embodiment of a spanner assembly 10 is shown. A spanner assembly 10 may include an inner bracket 12 and an outer bracket 14 in slidable or telescopic communication with one another. An example embodiment of the brackets 12 and 14 is shown in FIGS. 7-9. The inner 12 and outer brackets 14 may each include a side surface 16, top surface 18, a bottom surface 20, and a rear surface. The outer bracket 14 may be sized to allow for the inner bracket 12 to be slidably inserted within a cavity or aperture defined by the various surfaces of the outer bracket 14. For example, the top 18, bottom 20, and rear 22 surfaces of the outer bracket 14 may be enlarged and/or elongated relative to the surfaces 18, 20, and 22 of the inner bracket 12, wherein the surfaces 18, 20, and 22 of the outer bracket 14 may define a cavity for at least partially encircling the inner bracket 12. The outer bracket 14 may also include a lip 28 extending in a generally transverse direction from an edge of the top surface 18 and/or the bottom surface 20. The lip 28 may be configured to at least partially enclose the cavity defined by the top, bottom, and rear surfaces of the outer bracket 14, while allowing the inner and outer brackets 12 and 14 to slidably engage one another. The brackets 12 and 14 may be constructed of a steel alloy, carbon fiber composite, or a material with a similar strength and rigidity profile and/or characteristics. While the brackets 12 and 14 are shown in a generally square or rectangular configuration, it is further contemplated that brackets 12 and 14 may be constructed in the shape of an I-beam, a plate-like member, round or elliptical shape, or similar beam-like structure. The alternative shape configurations for the brackets 12 and 14 may be modified to allow for a first beam and a second beam to be slidably engaged and adapted to be attached to adjacent joist members 60.

Figure 12:
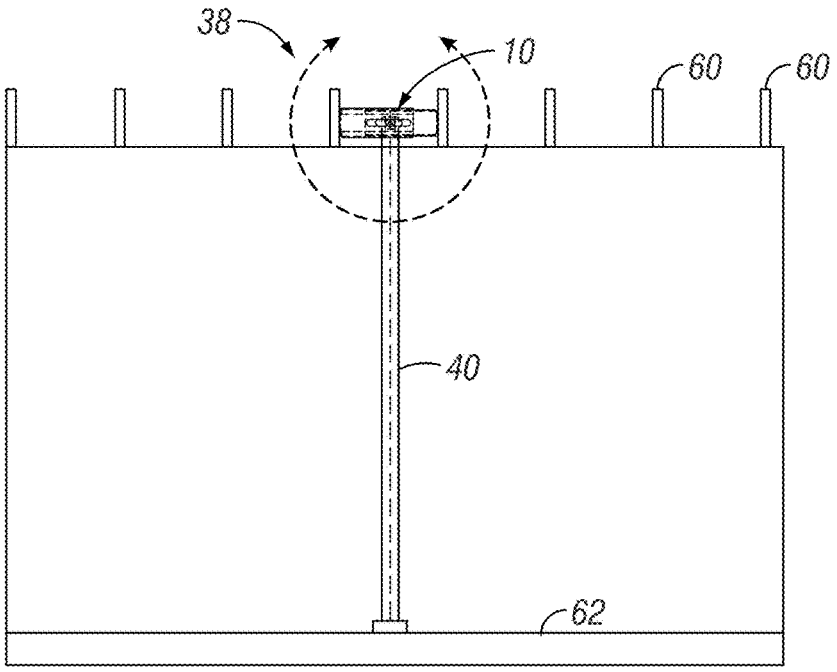
FIG. 12 is a front view of an exemplary embodiment of a wall reinforcement system including a spanner assembly.
Figure 13:
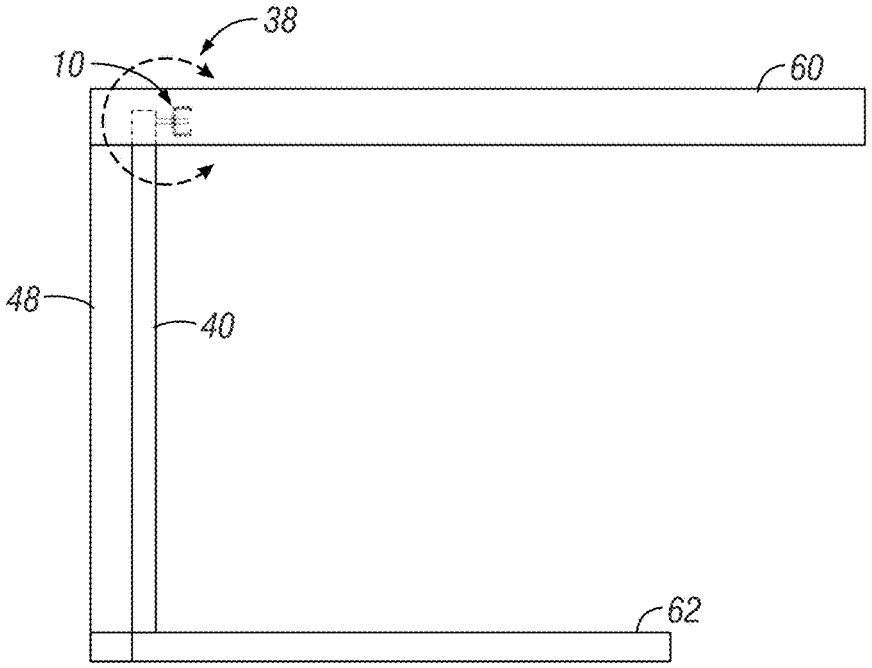
FIG. 13 is a side view of the wall reinforcement system including a spanner assembly of FIG. 12.
Figure 14:
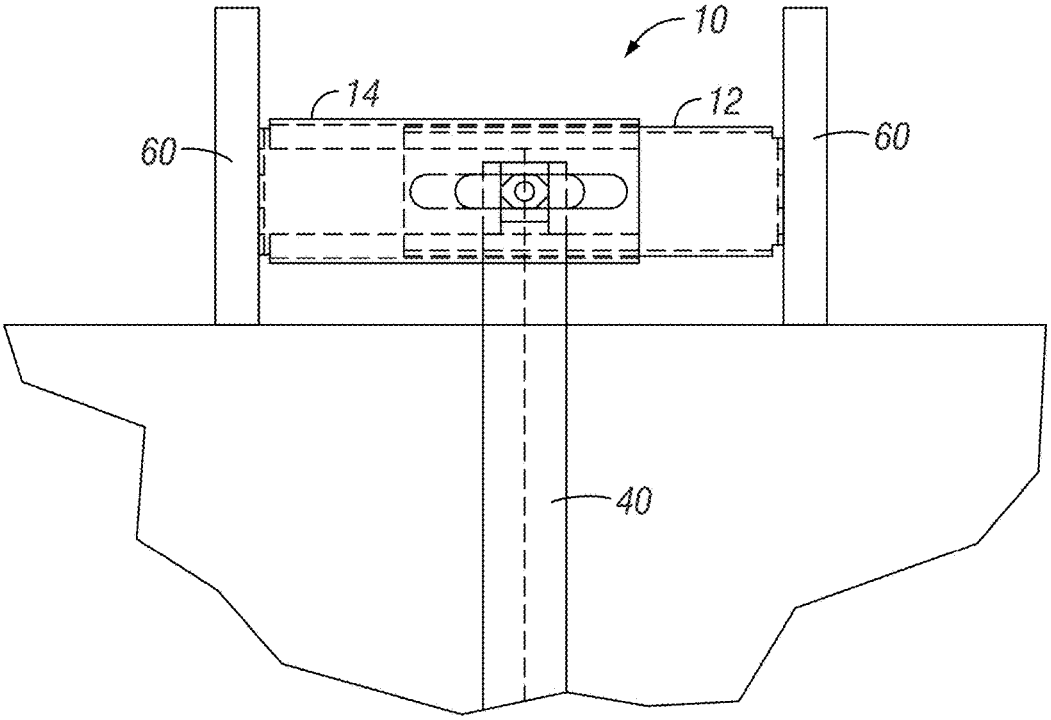
FIG. 14 is an enlarged view of the wall reinforcement system including a spanner assembly of FIG. 12.
Figure 15:
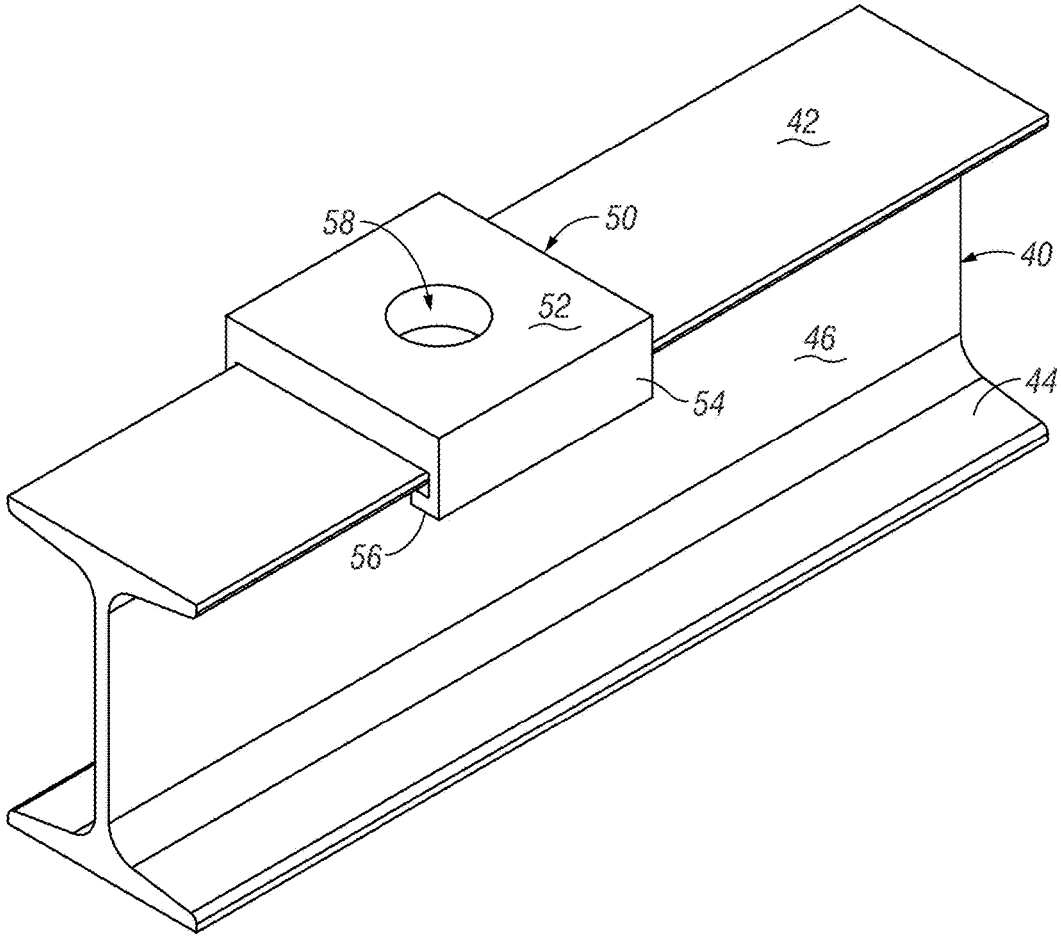
FIG. 15 is a perspective view of a channel bracket slidably attached to a support member.
Figure 16:
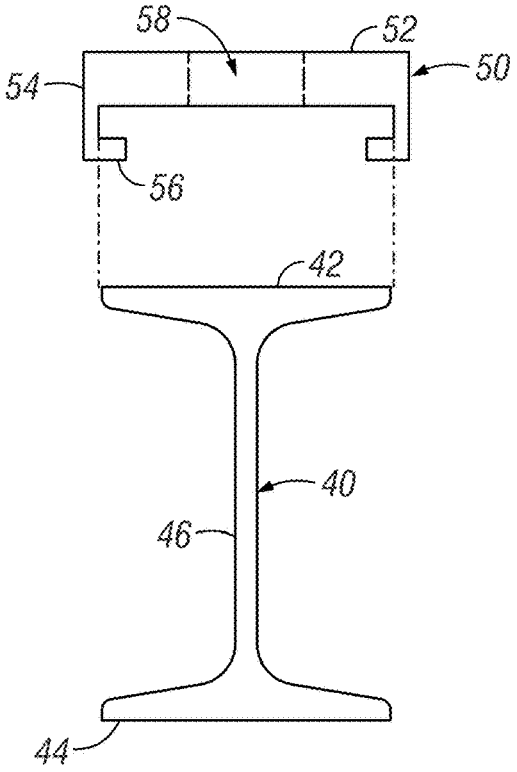
FIG. 16 is a side view of the channel bracket of FIG. 15 positioned relative a support member.
Figure 17:
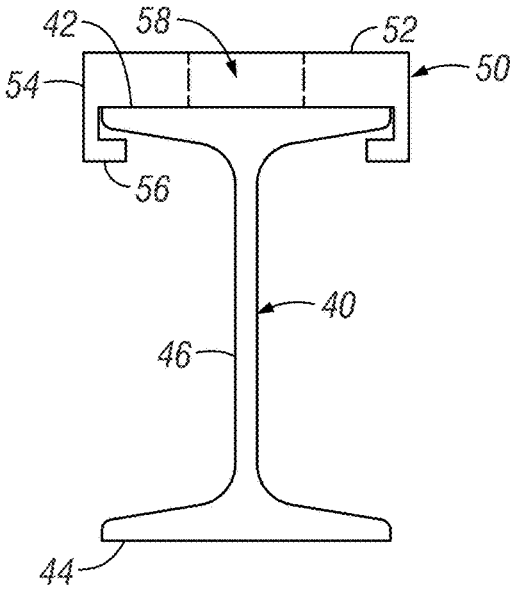
FIG. 17 is a side view of the channel bracket of FIG. 15 attached to a support member.
Figure 18:
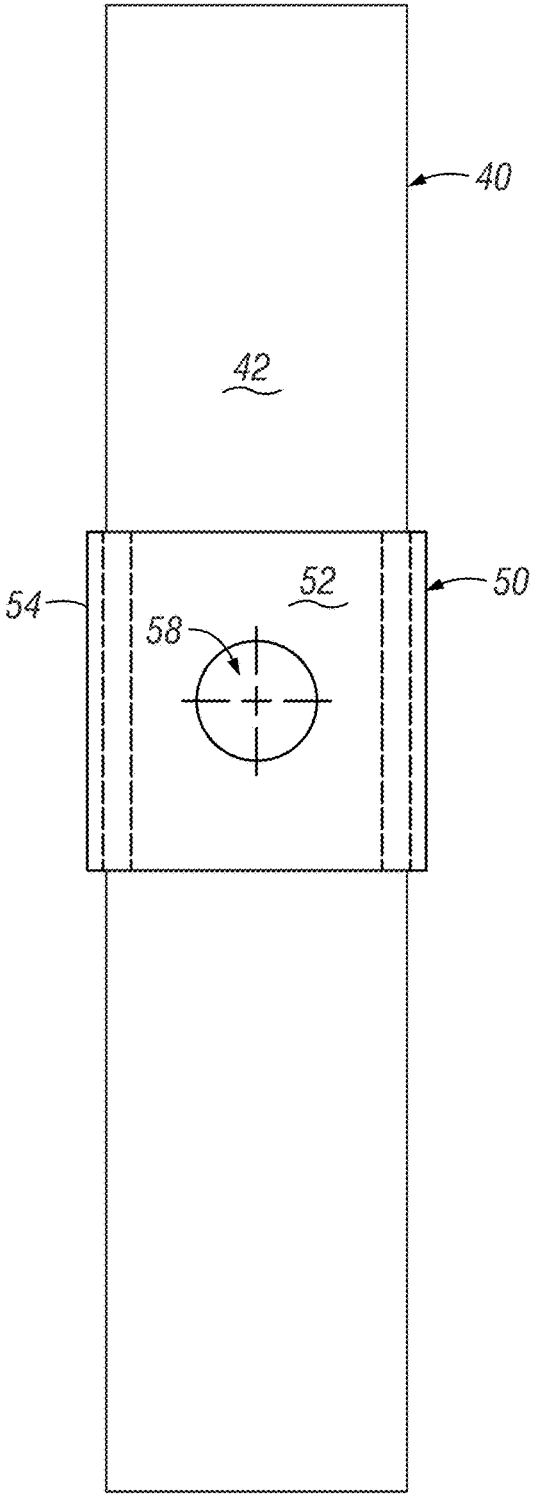
FIG. 18 is a top view of the channel bracket of FIG. 15 attached to a support member.

The side surfaces 16 of the inner 12 and/or outer brackets 14 may further include one or more apertures 26. The aperture(s) 26 in the side surface(s) 16 may be configured to receive a fastener for attaching the inner and outer brackets 12 and 14 to adjacent joist members 60, as shown in FIGS. 12-14. For example, the side surface 16 of the outer bracket and the inner bracket may be moved in opposing directions to abut the side surfaces 16 to opposing adjacent joist members 60. A nut and bolt, a lag bolt, a screw, nail, or similar type of fastener may be extended and/or inserted through the aperture(s) 26 to secure the side surface 16 of the brackets 12 and 14 to opposing joist members 60.

Furthermore, the brackets 12 and 14 may also each include a slot, track, or elongated hole/aperture 24 in the back surface of the outer 14 and/or inner brackets 12, as shown in FIG. 8. The slot 24 allows for the inner and outer brackets 12 and 14 to be in telescopic communication while still providing a passage for receiving a fastener to attach the spanner assembly 10 to a support member 40. The slot also allows for the support member 40 to be attached at a greater range of locations along the spanner assembly 10. The length of the slot may be sized as required to provide the necessary range of adjustability of the inner and outer brackets 12 and 14. For example, the support member is not limited to being attached at a center point of the spanner assembly 10, or proximate to a joist member 60. By contrast, the slots 24 in the spanner assembly 10 allow for the support member to be attached. The slot 24 of the inner and outer bracket 12 and 14 may be cut to any length to accommodate the spacing of the support members. This may be influenced by the distance between adjacent joist members 60. While not shown, it is also contemplated that the brackets 12 and 14 may include additional holes, slots, grooves, or the like, for attaching one or more support members 40 to the spanner assembly 10 at predefined locations providing a specific gap or spacing between adjacent support members. For example, the outer bracket 14 may include a slot 24 and the inner bracket 12 may include a plurality of holes that align with the slot of the outer bracket 24. The plurality of holes in the inner bracket 12 configured to receive a fastener for securing one or more support members 40 to the spanner assembly 10 at a predefined spacing. Furthermore, the brackets 12 and 14 may be configured to include slots or grooves that matingly engage. For example, the outer surface of the top surface of inner bracket 12 may include grooves that are configured to engage with grooves on the inner surface of the top surface of the outer bracket 14, wherein the grooves matingly engage to provide a plurality of predefined lengths for the spanner assembly 10.

Figure 4:
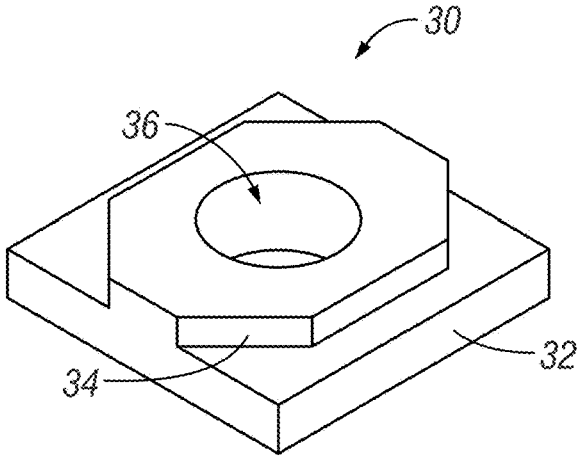
FIG. 4 is a perspective view of an exemplary embodiment of a slot nut for use with the spanner assembly of FIG. 1.
Figure 5:
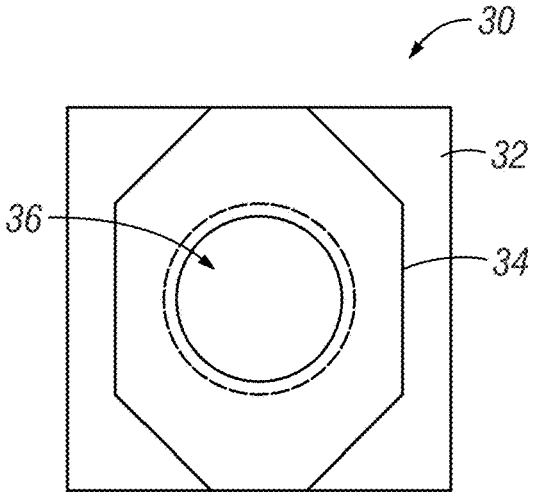
FIG. 5 is a top view of the slot nut of FIG. 4.
Figure 6:
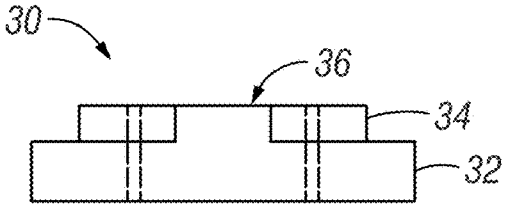
FIG. 6 is a side view of the slot nut of FIG. 4.

The spanner assembly 10 may also include a slotted nut 30. Referring to FIGS. 4-6, various views of an example embodiment of a slotted nut 30 is shown. The slotted nut 30 may include a base portion 32. The base portion may be round, square, or a similar polygonal shape. For example, the base may be a hexagonal shape configured for use with a standard or metric end-wrench. Extending or protruding from the base is a protrusion 34. The protrusion may be sized to snuggly fit within the outer slot 24 of the outer bracket. For example, the outer edges of the protrusion 34 may be configured to be slightly narrower than the width of the outer slot 24 of the outer bracket 14. This may allow the protrusion 34 to extend into the outer slot 24 of the outer bracket 14, but not allow the slotted nut 30 to be rotated within the outer slot 24. For example, the outer edges of the protrusion may slidably engage an interior edge of the outer slot 24 of the outer bracket 14 in a side direction without being able to rotate the slotted nut 30 when the protrusion is inserted into the outer slot 24. Sizing the protrusion 34 to prevent rotation of the nut 30 when inserted into the outer slot 24 may allow a bolt or similar fastener to be secured to the nut 30 without need for additional tools or wrenches. For example, the nut 30 may also include an aperture 36 configured to receive a fastener. The fastener may be a bolt, screw, rivet or the like. In one embodiment, the aperture 36 may include interior threads configured to receive a bolt. Once the opposing side surfaces 16 of the inner 12 and outer brackets 14 are secured to adjacent joist members 60, the protrusion 34 of the nut 30 may be inserted into the outer slot 24. A bolt may be inserted through the inner slot and outer slot 24 and threaded into the nut 30. The head of the bolt may be tightened using a wrench, socket, screwdriver, etc. while the outer slot 24 prevents the slotted nut 30 from rotating. While the assembly is shown and described as including a slotted nut 30, it should be understood that it is contemplated that a bolt with a slotted head may also be used with the slots 24 of the brackets 12 and 14.

Alternatively, the aperture 36 of the slotted nut 30 may not include any threads, and the slotted nut 30 may act as a washer, configured to receive a fastener and orient the fastener within the inner and outer slots 24 of the brackets 12 and 14. This will allow the fastener to be slidably positioned along the inner and outer slot 24. Furthermore, the slotted washer 30 would provide a snug fit for various sized fasteners passing through the slots 24 without having to match the slots 24 to the fastener size. For example, the slotted washer may be configured to include an aperture 36 of various sizes, wherein the washer 30 (for example, a bolt) may be selected to fit the size of the fastener.

While not shown in the figures, in yet another embodiment of the spanner assembly 10, the inner slot 24 of the inner bracket 12 may be configured to be larger than the outer slot 24 of the outer bracket 14. In this embodiment, the slotted nut 30 may be configured to be positioned within the interior cavity defined by the top, bottom, rear, and side surfaces of the inner bracket 12. As described above, the protrusion 34 of the slotted nut may be inserted within the inner slot 24 of the inner bracket, wherein the outer edge of the protrusion 34 may slidably engage an interior surface of the inner slot 24. A fastener, such as a bolt, may then be inserted through the outer slot 24 of the outer bracket and threadably engage the slotted nut 30.

As previously discussed, an elongated vertical member 40 may be slidably attached to the spanner assembly 10 via a fastener to create a wall reinforcement system 38. An example embodiment of the wall reinforcement system 38 is shown in FIGS. 12-14. The fastener may include the slotted nut 30 described above. The inner and outer slots 24 of the inner 12 and outer brackets 14 allow the nut 30 to be slidably positioned within the track 24. This may allow the vertical member 40 to be positioned at a greater number of locations along the wall 48 between joist members 60. For example, wherein the vertical members 40 may have previously been limited to being positioned immediately adjacent a single joist member 60, the spanner assembly 10 allows for the vertical member 40 to be positioned at intermediate locations between adjacent joist members 60. This allows for a greater flexibility in designing a wall reinforcement system to support a specific loading or force profile. For example, if the joist 60 were previously spaced at sixteen inches (16"), a vertical member 40 would be limited to a sixteen-inch (16") or thirty-two-inch (32") spacing. However, utilizing the spanner assembly 10 described above, a plurality of spanner assemblies 10 may be affixed between adjacent joist members 60 and the vertical members 40 may be spaced every twelve inches (12"), every twenty-four inches (24"), or some other spacing, as is required to support the wall 48.

While the elongated vertical member 40 shown in the figures is oriented in a generally vertical configuration, it is also contemplated that the vertical member may be oriented at an angle. For example, adjacent vertical members may be oriented at reciprocal angles to create an x-like configuration. It is also contemplated that if oriented in an x-like configuration, one of the vertical members may be two pieces, with one end of each of the pieces attached to the solid vertical member at an intersection point. The vertical support members may be constructed of a steel alloy, carbon fiber composite, or a material with a similar strength and rigidity profile and/or characteristics. The vertical support member may be constructed in the shape of an I-beam, a bar, a rod, a rectangular or round shaped pipe/tube, or similar beam-like structure. For example, the vertical member may be constructed in the shape of an I-beam with a front flange portion 42 and a rear flange portion 44 that are interconnected by a web portion 46. If the vertical support member 40 is in the shape of an I-beam, the flat surface of the rear flange 44 may be positioned to abut the wall 48 to be supported, with the web portion 46 extending away from the wall 48 and the front flange 42 attached to the web 46 opposite the rear flange 44. The front flange 42 of the vertical member 40 may be configured to engage the rear surface of the outer bracket 14 of the spanner assembly 10. The front flange 42 proximate to the top end of the vertical member may be adapted or configured to include or receive a fastener that may extend through the slotted nut 30 and/or the slots of the brackets 12 and 14. For example, a bolt may be welded to the front surface of the front flange 42 of the vertical member proximate to the top end of the vertical member 40. The bolt may be configured to extend away from the wall 48 and be received by the slotted nut 30 and/or the slots of the brackets 12 and 14. It is also contemplated that a hole or aperture may be drilled in the front flange 42 proximate to the top end of the vertical member 40 to allow a bolt to be inserted therethrough. The hole may be positioned and/or located proximate the left or right edge of the front flange 42. The opposing end of the vertical member 40 may be affixed proximate to the floor 62.

While not shown in the figures, it is also contemplated that one or more horizontal support members may be included. Opposing ends of the horizontal support members may be attached to adjacent vertical support members to create a grid-like configuration. The horizontal support members may be attached to the vertical members 40 via a cinch plate. An example of a method, system, and/or apparatus for reinforcing a wall 48 with horizontal support members is disclosed in U.S. Ser. No. 14/932,225, now U.S. Pat. No. 9,422,734, which is again herein incorporated by reference in its entirety. The cinch plate may allow one or more horizontal support members to be attached at any point along the length of adjacent vertical support members 40. One or more horizontal members may be spaced along the length of adjacent vertical members to provide necessary support and rigidity required to support and/or reinforce a wall 48. The horizontal support members may be constructed of a steel alloy, carbon fiber composite, or a material with a similar strength and rigidity profile and/or characteristics. The horizontal support member may be constructed in the shape of an I-beam, a bar, a rod, a rectangular or round shaped pipe/tube, or similar beam-like structure.

Referring to FIG. 15-18, a channel bracket 50 for the wall reinforcement system 38 is shown. The channel bracket 50 includes a top portion 52 and one or more side portions 54 extending from the edge of the top portion in a generally transverse direction. The side portion(s) 54 may also include a lip 56 extending in a generally transverse direction from the side portion, but oriented to be generally parallel to the top portion 52. The channel bracket 50 may be configured to be slidably engaged with a flange portion 42 of the vertical 40 or horizontal support members. For example, the top portion 52 may abut the flat surface of the flange portion 42 of the vertical member 40, wherein the top portion 52 is sized to be at least slightly wider than the flange 42 of the member 40. The side portions 24 of the channel bracket 50 may be sized to extend past the edge of the flange 42, wherein the length of the side portion is at least slightly longer than the thickness of the flange 42. The lip 56 may then be configured to at least partially extend inward toward the web 46 of the support member, slidably securing the channel bracket 50 to the flange 42 of the vertical member 40.

The channel bracket 50 may also include one or more apertures 58. The apertures 58 may include interior threads or similar means of attaching or affixing a fastener to the bracket 50. The aperture(s) 58 of the channel bracket 50 may be configured to secure the bracket 50 at a desired position or location along the length of the vertical 40 or horizontal member. For example, the bracket 50 may be slid to a desired location on the vertical member 40 and a bolt may be threadably engaged with the interior threads of the aperture 58. The bolt may then be tightened until the tip of the bolt contacts the flange of the vertical member 40, creating a friction fit and securing the bracket 50 at the location. The aperture(s) 58 of the bracket may also be utilized to attach a horizontal support member to a vertical support member 40, or vice versa.

The disclosure is not to be limited to the particular embodiments described herein. In particular, the disclosure contemplates numerous variations in the type of ways in which embodiments of the disclosure can be applied to straightening and/or supporting a wall 48. The foregoing description has been presented for purposes of illustration and description. It is not intended to be an exhaustive list or limit any of the disclosures to the precise forms disclosed. It is contemplated that other alternatives or exemplary aspects are considered included in the disclosure. For example, the structure and function of the elongated vertical members 40 and the elongated horizontal members can be switched. In such an exemplary embodiment, the elongated horizontal members extend between, for example, two opposing sidewalls of a room. The elongated vertical members 14 would then extend between a pair of elongated horizontal members and perform the functions of the same previously expressed herein. The description is merely examples of embodiments, processes or methods of the disclosure. It is understood that any other modifications, substitutions, and/or additions can be made, which are within the intended spirit and scope of the disclosure. For the foregoing, it can be seen that the disclosure accomplishes at least all that is intended.

The previous detailed description is of a small number of embodiments for implementing the disclosure and is not intended to be limiting in scope. The following claims set forth a number of the embodiments of the disclosure with greater particularity.

What is claimed is:

1. A joist spanner system, said system comprising:

a spanner assembly comprising:

an outer bracket having a top, a bottom, a side, and a rear surface;

an inner bracket slidably interconnected to the outer bracket, said inner bracket having a top, a bottom, a side, and a rear surface;

said outer bracket having an outer slot in the rear surface of the outer bracket, a top lip extending from a top edge of the top surface of the outer bracket, and a bottom lip extending from a bottom edge of the bottom surface of the outer bracket;

said inner bracket having an inner slot in the rear surface of the inner bracket slidably aligned with the outer slot of the outer bracket;

wherein the top lip and the bottom lip slidably secure the inner bracket within an interior cavity defined by the top, bottom, side, and rear surface of the outer bracket;

a slot nut having a base, a protrusion, and an aperture extending through the protrusion and the base;

said protrusion having outer edges that (1) are narrower than a width of the outer slot, (2) slidably engage an interior edge of the outer slot, and (3) are sized to prevent rotation of the slot nut; and a channel bracket configured to slidably engage a front flange of an elongated vertical member comprising:

a body;

opposing side members extending from one or more sides of the body; and lips extending from opposing side members configured to engage the elongated vertical member;

wherein the joist spanner system supports a partially subterranean wall.

2. The system of claim 1, wherein the outer slot is larger than the inner slot.

3. The system of claim 1, wherein the side surface of the outer bracket and the side surface of the inner bracket each have one or more apertures.

4. The system of claim 3, wherein the one or more apertures of the side surface of the outer bracket and the side surface of the inner bracket are configured to receive a fastener for securing the side surface of the outer bracket and the side surface of the inner bracket to opposing joists.

5. A wall reinforcement system, the system comprising:

a spanner assembly comprising:

an inner bracket having a top, a bottom, a side, and a rear surface; and an outer bracket having a top, a bottom, a side, and a rear surface, said outer bracket having a top lip extending from a top edge of the top surface of the outer bracket and a bottom lip extending from a bottom edge of the bottom surface of the outer bracket;

said top lip and bottom lip slidably securing the inner bracket within an interior cavity defined by the top, bottom, side, and rear surface of the outer bracket;

a slot nut having a base, a protrusion, and an aperture extending through the protrusion and the base;

said protrusion having outer edges that (1) are narrower than a width of the outer slot, (2) slidably engage an interior edge of the outer slot, and (3) are sized to prevent rotation of the slotted nut;

an elongated vertical support member having a first end and a second end, said first end slidably attached to the inner bracket and outer bracket by a fastener passing through an inner slot in the rear surface of the outer bracket and an outer slot in the rear surface of the inner bracket; and a channel bracket configured to slidably engage a front flange of the elongated vertical member comprising:

a body;

opposing side members extending from one or more sides of the body; and lips extending from opposing side members configured to engage the elongated vertical member;

wherein the wall reinforcement system supports a partially subterranean wall.

6. The system of claim 5, wherein the outer slot is larger than the inner slot, and the inner slot and outer slot are slidably aligned with each other.

7. The system of claim 6, wherein the side surface of the outer bracket and the side surface of the inner bracket are positioned to abut opposing joist members.

8. The system of claim 5, wherein the elongated vertical support member is generally parallel with a second vertical support member and further wherein the vertically elongated support members are interconnected by a horizontal member.

9. The system of claim 5, wherein the elongated vertical member is an I-beam comprising:

a rear flange and the front flange connected by a web portion, said rear flange portion configured to abut the subterranean wall.

10. A method of straightening or supporting a wall, the method comprising the steps of:

providing the wall reinforcement system of claim 5;

positioning the spanner assembly between two opposing joist members;

slidably adjusting the inner bracket and the outer bracket to position each of the side surfaces to abut the two opposing joist members;

positioning a flange portion of the elongated vertical member to abut the wall;

securing the elongated vertical member in a desired position on a floor; and securing the elongated vertical member to the spanner assembly.

11. The method of claim 10, further comprising the steps of:

providing a second spanner assembly;

positioning the second spanner assembly between an adjacent pair of joists;

slidably adjusting the second spanner assembly to position side plates of the second spanner assembly to abut opposing joists of the adjacent pair of joists;

providing a second elongated vertical member;

positioning the second elongated vertical member to abut the wall adjacent the elongated vertical member;

securing the second elongated vertical member in a desired position on a floor; and securing the second elongated vertical member to the second spanner assembly.

12. The method of claim 11, further comprising the steps of:

providing one or more transverse elongated members perpendicular to the vertical elongated member and the second vertical elongated member, said one or more transverse elongated members having a first end and a second end;

position the one or more transverse elongated members between the vertical elongated member and the second vertical elongated member; and securing the first end of one or more transverse elongated members to the vertical elongated member and securing the second end of one or more transverse elongated members to the second vertical elongated member.

13. The method of claim 12, wherein the one or more transverse elongated members are generally oriented in parallel to one another.

14. The method of claim 11, wherein the elongated vertical member and the second elongated vertical member are oriented to be substantially parallel to one another.

* * * * *